US009373318B1

(12) United States Patent
Piersol et al.

(10) Patent No.: US 9,373,318 B1
(45) Date of Patent: Jun. 21, 2016

(54) SIGNAL RATE SYNCHRONIZATION FOR REMOTE ACOUSTIC ECHO CANCELLATION

(71) Applicant: Rawles LLC, Wilmington, DE (US)

(72) Inventors: Kurt Wesley Piersol, San Jose, CA (US); Preethi Parasseri Narayanan, Cupertino, CA (US); Robert Ayrapetian, Morgan Hill, CA (US); Arnaud Jean-Louis Charton, Livermore, CA (US); Gabe Beddingfield, Fremont, CA (US); Michael Alan Pogue, Sunnyvale, CA (US); Yuwen Su, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 159 days.

(21) Appl. No.: 14/228,045

(22) Filed: Mar. 27, 2014

(51) Int. Cl.
*G10K 11/175* (2006.01)

(52) U.S. Cl.
CPC ..... *G10K 11/175* (2013.01)

(58) Field of Classification Search
CPC ..... G10K 11/175; G10K 11/16; H04M 3/002; H04M 3/567; H04M 3/568; H04M 9/082; H04M 3/56; G10L 2021/02082; G10L 21/0208; G10L 21/02; H01R 3/02; H01R 3/002
USPC ..... 381/66, 71.1, 71.8, 71.9, 71.11, 71.13, 381/94.1, 94.4, 94.7; 700/94; 455/501, 502; 379/406.01, 406.02, 406.06, 406.08, 379/406.1
See application file for complete search history.

(56) References Cited

U.S. PATENT DOCUMENTS

| | | | | |
|---|---|---|---|---|
| 7,016,443 | B1 * | 3/2006 | Splett | H04J 3/0667 370/324 |
| 7,023,868 | B2 * | 4/2006 | Rabenko | H04B 3/23 348/E7.049 |
| 7,418,392 | B1 | 8/2008 | Mozer et al. | |
| 7,680,285 | B2 * | 3/2010 | Ballantyne | H04B 3/493 379/406.02 |
| 7,720,683 | B1 | 5/2010 | Vermeulen et al. | |
| 7,774,204 | B2 | 8/2010 | Mozer et al. | |
| 8,295,475 | B2 * | 10/2012 | Li | H04M 9/082 379/406.01 |

(Continued)

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

*Primary Examiner* — Vivian Chin
*Assistant Examiner* — Jason R Kurr
(74) *Attorney, Agent, or Firm* — Lee & Hayes, PLLC

(57) ABSTRACT

A system may be configured to interact with a user through speech using a first and second audio devices, where the first device produces audio and the second device captures audio. The second device may be configured to perform acoustic echo cancellation with respect to a microphone signal based on a reference signal provided by the first device. The reference and microphone signals may have the same nominal signal rates. However, the signal rates may drift from each other over time. In order to synchronize the rates of the signals, each of the devices maintains a signal index. The second device compares the values of the two signal indexes over time to determine rate differences between the reference and microphone signals and then corrects for the rate differences.

20 Claims, 7 Drawing Sheets

(56) References Cited

U.S. PATENT DOCUMENTS 8,320,554 B1 * 11/2012 Chu ..... H04M 9/082 379/406.08
8,515,086 B2 * 8/2013 Marton ..... H04M 9/082 379/406.02
8,958,897 B2 * 2/2015 Cleve ..... H04M 3/002 455/502
9,025,762 B2 * 5/2015 Bao ..... H04M 9/082 379/406.06
2012/0223885 A1 9/2012 Perez

* cited by examiner

SIGNAL RATE SYNCHRONIZATION FOR REMOTE ACOUSTIC ECHO CANCELLATION

BACKGROUND

As the processing power available to devices and associated support services continues to increase, it has become practical to interact with users through speech. For example, various types of devices may generate speech or render other types of audio content for a user, and the user may provide commands and other input to the device by speaking.

In a device that produces sound and that also captures a user's voice for speech recognition, acoustic echo cancellation (AEC) techniques are used to remove device-generated sound from microphone input signals. The effectiveness of AEC in devices such as this is an important factor in the ability to recognize user speech in received microphone signals.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
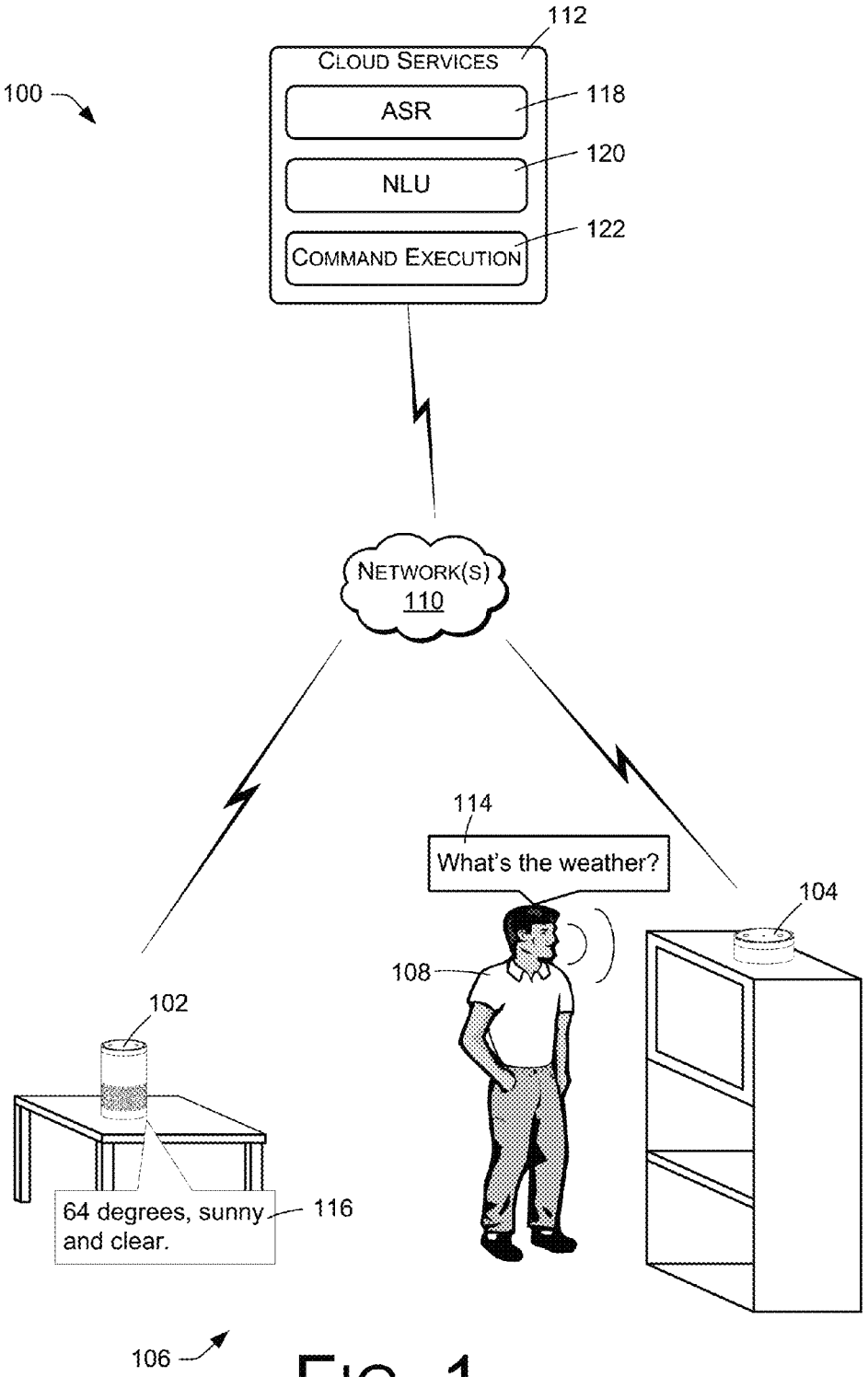
FIG. 1 shows an illustrative voice interactive computing architecture that includes primary and secondary assistants that interact by voice with a user in conjunction with cloud services.

A distributed voice controlled system may be used to interact with a user through speech, including user speech and device generated speech. In certain embodiments, the distributed voice controlled system may have a primary assistant and one or more secondary assistants. The primary assistant has a microphone for capturing input audio and a speaker for generating output audio. The input audio may include user speech and other environmental audio. The output audio may include machine-generated speech, music, spoken word, or other types of audio.

The secondary assistant has a microphone that may be used to supplement the capabilities of the primary assistant by capturing user speech or other environmental audio signals from a different location than the primary assistant. The distributed voice controlled system may utilize the audio captured by either or both of the primary and secondary assistants to recognize, interpret, and respond to speech uttered by the user and/or the other environmental audio signals.

The microphone of the secondary assistant produces an analog signal that is converted to a digital input signal comprising a series of signal values that are generated and provided at a nominal signal rate. The signal rate of the input signal corresponds to the number of signal values that occur during a given time period. For example, the signal rate of the input signal may be 48 kHz, meaning that the input signal is represented by 48,000 signal values per second.

The secondary assistant may be configured to perform acoustic echo cancellation (AEC) to remove components of the speaker-generated output audio from the input signal of the secondary assistant. The AEC is based on a digital reference signal provided by the primary assistant. Similar to the input signal, the reference signal comprises a series of signal values that are generated and provided at a nominal signal rate. The AEC is most effective when the reference signal has the same signal rate as the input signal of the secondary assistant. To achieve this, the primary and secondary assistants may use signaling clocks of the same frequency, so that the reference signal and the input signal of the secondary assistant have the same signal rates. In real-world situations, however, the frequencies of the clocks may drift independently over time. Accordingly, the reference signal and the input signal may not have exactly the same signal rates.

To achieve signal rate synchronization at the secondary assistant, the primary and secondary assistants use respective signal clocks having the same nominal frequencies. A counter in the primary assistant is responsive to the signal clock of the primary assistant to produce a reference index. A counter in the secondary assistant is responsive to the signal clock of the secondary assistant to produce an input index. The reference signal is provided to the secondary assistant in groups or frames of signal values, accompanied by a current value of the reference index. Upon receiving a frame of the reference signal values and the corresponding value of the reference index, the secondary assistant records the current value of its input index. Differences between corresponding values of the reference index and the input index are analyzed over time to determine a time-averaged signal rate difference between the reference signal and the input signal. Based on the signal rate difference, samples are added to the input signal or subtracted from the microphone input signal at the secondary assistant so that the signal rate of the microphone input signal matches the signal rate of the reference signal.

FIG. 1 shows an example of a distributed voice controlled system 100 having a primary assistant 102 and one or more secondary assistants 104. The system 100 may be implemented within an environment 106 such as a room or an office, and a user 108 is present to interact with the voice controlled system 100. Although only one user 108 is illustrated in FIG. 1, multiple users may use the voice controlled system 100.

In this illustration, the primary voice controlled assistant 102 is physically positioned on a table within the environment 106. The primary voice controlled assistant 102 is shown sitting upright and supported on its base end. The secondary assistant 104 is placed on a cabinet or other furniture and physically spaced apart from the primary assistant 102. In other implementations, the primary assistant 102 and secondary assistant 104 may be placed in any number of locations (e.g., ceiling, wall, in a lamp, beneath a table, on a work desk, in a hall, under a chair, etc.). When in the same room, the two assistants 102 and 104 may be placed in different areas of the room to provide greater coverage of the room. Although only one secondary assistant 104 is illustrated, there may be any number of secondary assistants as part of the system 100.

The assistants 102 and 104 are configured to communicate with one another via one or more wireless networks or other communications media 110, such as Bluetooth, Ethernet, Wi-Fi, Wi-Fi direct, or the like. Each of the voice controlled assistants 102 and 104 is also communicatively coupled to cloud services 112 over the one or more networks 110. In some cases, the primary assistant 102 and the secondary assistant 104 may utilize local communications such as Bluetooth or local-area network connections for communications with each other. Furthermore, the secondary assistant 104 may communicate with the cloud services 112 through the primary assistant 102.

The cloud services 112 may host any number of applications that can process user input received from the voice controlled system 100 and produce suitable responses. Example applications might include web browsing, online shopping, banking, bill payment, email, work tools, productivity, entertainment, educational, and so forth.

In FIG. 1, the user 108 is shown communicating with the cloud services 112 via assistants 102 and 104. In the illustrated scenario, the user 108 is speaking in the direction toward the secondary assistant 104, and uttering a spoken query 114, "What's the weather. The secondary assistant 104 is equipped with one or more acoustic-to-electric transducers or sensors (e.g., microphones) to receive the voice input from the user 108 as well as any other audio sounds in the environment 106.

The user 108 may also speak in the direction toward the primary assistant 102, which may also have one or more acoustic-to-electric transducers or sensors (e.g., microphones) to capture user speech and other audio. The cloud services may respond to an input from assistants 102 and/or 104.

In response to the spoken query 114, the system 100 may provide a speech response 116. The speech response 116 may be generated by the primary assistant 102, which may have one or more speakers to generate sound. In this example, the speech response 116 indicates, in response to the spoken query 114, that the weather is "64 degrees, sunny and clear."

Functionally, one or more audio streams may be provided from the assistants 102 and/or 104 to the cloud services 112. The audio provided by the microphones of the assistants 102 and 104 may be processed by the cloud services 112 in various ways to determine the meaning of the spoken query 114 and/or the intent expressed by the spoken query 114. For example, utilizing known techniques, the cloud services may implement automated speech recognition (ASR) 118 to identify a textual representation of user speech that occurs within the audio. The ASR 118 may be followed by natural language understanding (NLU) 120 to determine the intent of the user 108. The cloud services 112 may also have command execution functionality 122 to compose and/or implement commands in fulfilment of determined user intent. Such commands may be performed by the cloud services 112 either independently or in conjunction with the primary assistant 102, such as by generating audio that is subsequently rendered by the primary assistant 102. In some cases, the cloud services may generate a speech response, such as the speech response 116, which may be sent to and rendered by the primary assistant 102.

The distributed voice controlled system 100 allows the user 108 to interact with local and remote computing resources predominantly through speech. By placing the primary assistant 102 and one or more secondary assistants 104 throughout the environment 106, the distributed voice controlled system 100 enables the user 108 to move about his or her home and interact with the system 100. With multiple points from which to receive speech input, the audio speech signals can be detected and received more efficiently and with higher quality, minimizing the problems associated with location and orientation of the speaker relative to the audio input devices.

Each of the assistants 102 and 104 may be configured to perform acoustic echo cancellation (AEC) with respect the audio signals produced by their microphones. Acoustic echo cancellation (AEC) is performed to remove or suppress components of any output audio that is produced by the speaker of the primary assistant 102.

Figure 2:
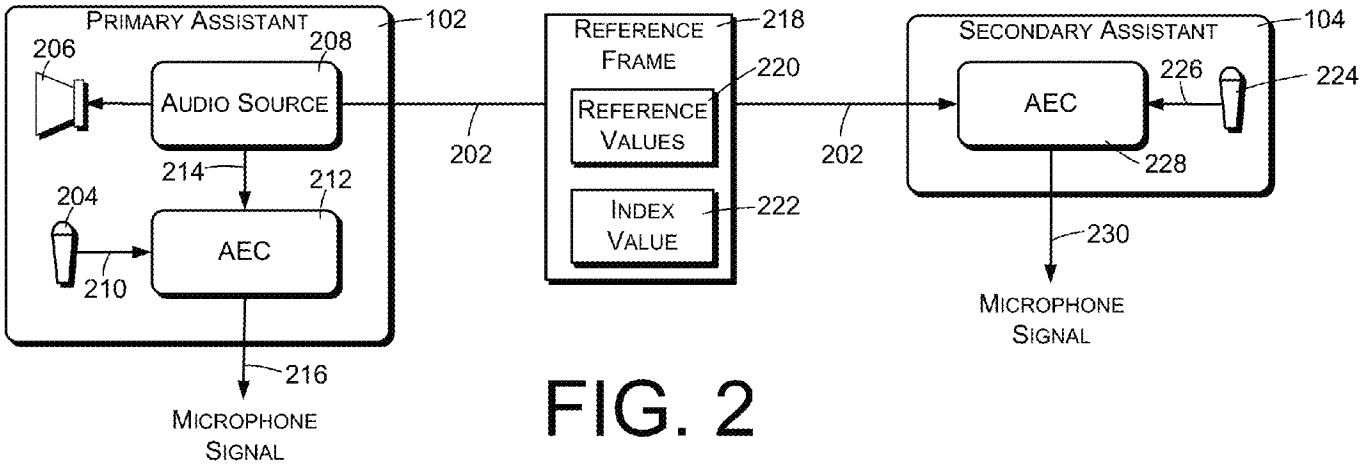
FIG. 2 is a block diagram illustrating an audio processing configuration that may be implemented within the architecture of FIG. 1 for acoustic echo cancellation.

FIG. 2 illustrates an example of how the primary assistant 102, which produces output audio, interacts with the secondary assistant 104 so that AEC may be performed on microphone signals of both the primary and secondary assistants 102 and 104. In this case, AEC is intended to cancel the output audio that is produced by the primary assistant 102. Accordingly, a reference signal 202, representing output audio of the primary assistant 102, is provided from the primary assistant 102 to the secondary assistant 104 and used by the secondary assistant 104 for AEC. The reference signal 202 may be provided using wireless communications such as Bluetooth or Wi-Fi. Wired communications media may also be used.

The reference signal 202 is a digital signal, comprising a sequence of reference signal values or samples. The reference signal values are provided at a rate that is referred to as a reference signal rate or reference sample rate. In the described embodiment, the nominal reference signal rate is 48 kHz, meaning that 48,000 signal values are generated and provided every second. However, other signal rates may also be utilized.

The primary assistant 102 has a microphone 204 and a speaker 206. The speaker 206 produces output audio in response to an audio source 208. The audio source 208 may comprise an audio stream, which may be provided from the cloud services 112, from a local file or data object, or from another local or remote source.

The microphone 204 creates an internal microphone signal 210 that is received and processed by an AEC component 212, also referred to herein as an acoustic echo canceller 212. The AEC component 212 performs acoustic echo cancellation based on a reference signal 214 corresponding to the audio source 208. The resulting echo-cancelled microphone signal 216 may in turn be provided to the cloud services 112 for speech recognition, language understanding, and command implementation. Alternatively, speech recognition, language understanding, and command implementation may in some embodiments be performed by the primary assistant itself.

The reference signal 202 may be provided to the secondary assistant 104 in groups or frames 218 of reference signal values 220. Each frame 218 is accompanied by a reference index value 222. The reference index value 222 is the current or most recent value of a reference index that is maintained by the primary assistant 102 to indicate a count of signal clock cycles at the primary assistant. The nature and use of the reference index value 222 will be explained in more detail below, with reference to FIG. 4. In one embodiment, the frames 218 may be provided at an average nominal rate of one frame per 8 milliseconds. In such an embodiment, each frame contains 384 signal values. This corresponds to the nominal signal rate of 48 kHz.

The secondary assistant 104 has a microphone 224 that provides an input audio signal 226. An AEC component 228, also referred to as an acoustic echo canceller 228, receives the input audio signal 226 and the reference signal 202 and performs echo cancellation to suppress or remove components of output audio from the input audio signal 226. The resulting echo-canceled microphone input signal 230 may in turn be provided to the cloud services 112 for speech recognition, language understanding, and command implementation. In some cases, the echo-canceled microphone signal 230 may be provided to the primary assistant 102, which may in turn provide the microphone signal 230 to the cloud-based services.

Figure 3:
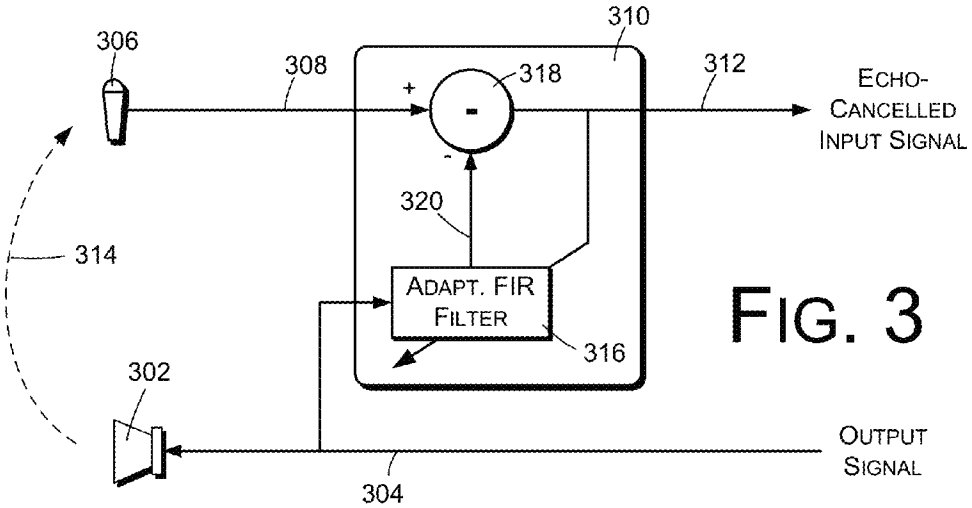
FIG. 3 is a block diagram illustrating an example technique for acoustic echo cancellation.

FIG. 3 illustrates a general example of AEC functionality. Functionality such as this may be implemented by either or both of the primary and secondary assistants 102 and 104. A speaker 302 is responsive to an output signal 304 to produce output audio within an environment. A microphone 306 is configured to produce an input signal 308 representing audio in the environment, which may include the output audio produced by the speaker 302. An AEC component 310 processes the input signal 308 to cancel or suppress components of the output audio from the input signal 308, and to produce an echo-suppressed or echo-cancelled input signal 312. Such components of the output audio may be due to one or more acoustic paths 314 from the speaker 302 to the microphone 306. The acoustic paths 314 may include a direct acoustic path from the speaker 302 to the microphone 306 as well as indirect or reflective paths caused by acoustically reflective surfaces within the environment.

The AEC component 310 receives the output signal 304, referred to as a reference signal in the AEC environment, which represents the output audio. The AEC component 310 has an adaptive finite impulse response (FIR) filter 316 and a subtraction component 318. The FIR filter 316 generates an estimated echo signal 320, which represents one or more components of the output signal 304 that are present in the input signal 308. The estimated echo signal 320 is subtracted from the input signal 308 by the subtraction component 318 to produce the echo-cancelled signal 312.

The FIR filter 316 estimates echo components of the input signal 308 by generating and repeatedly updating a sequence of filter parameters or coefficients that are applied to the reference signal 304 by the FIR filter 316. The adaptive FIR filter 316 calculates and dynamically updates the coefficients so as to continuously and adaptively minimize the signal power of the echo-cancelled input signal 312, which is referred to as an "error" signal in the context of adaptive filtering.

Referring again to FIG. 2, either or both of the AEC components 212 and 228 may be implemented by a signal processing element such as the AEC component 310 of FIG. 3.

Figure 4:
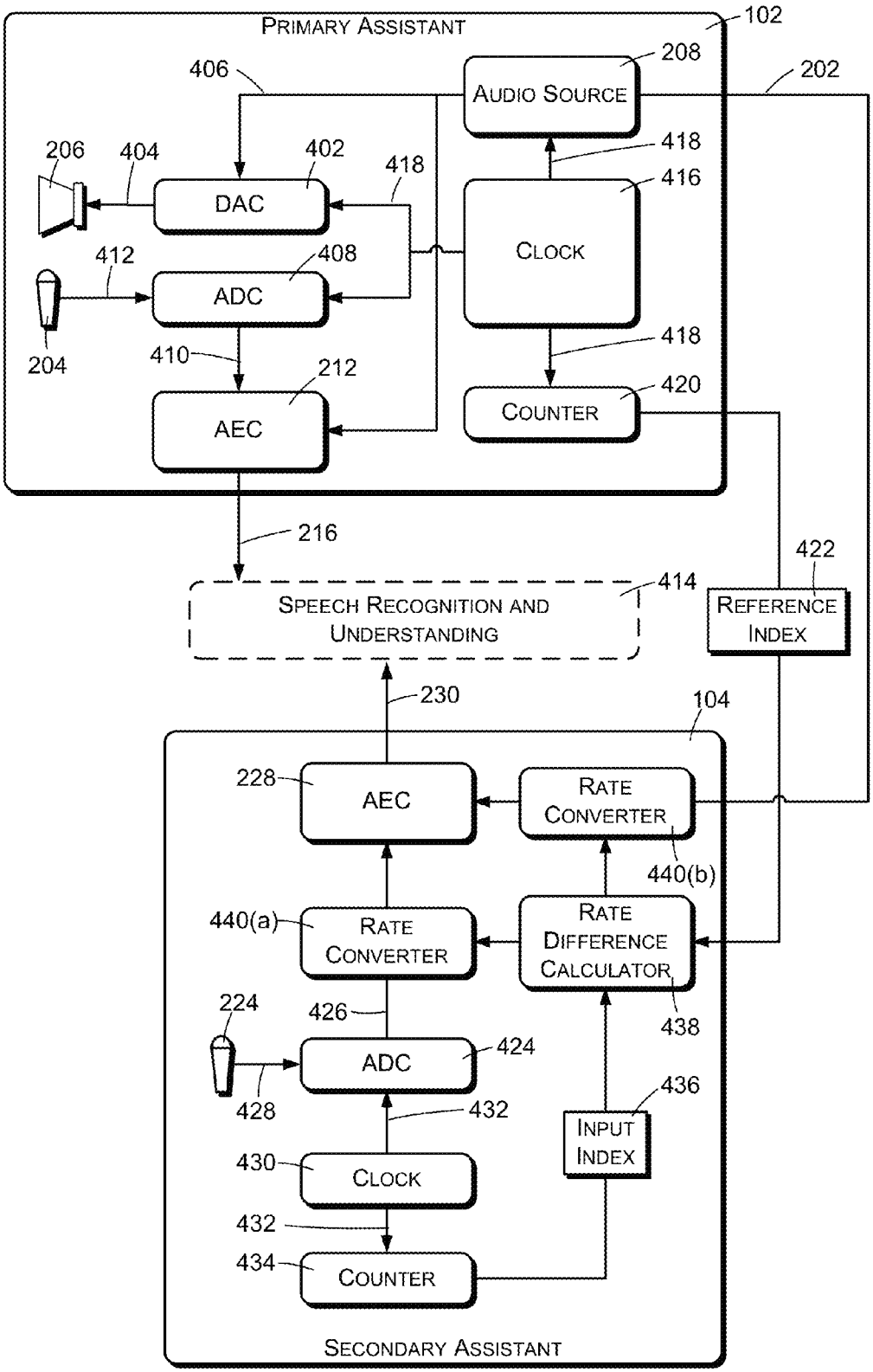
FIG. 4 is a block diagram illustrating further components of an audio processing configuration that may be implemented within the architecture of FIG. 1 for acoustic echo cancellation.

FIG. 4 illustrates further details regarding functional components of the primary and secondary assistants 102 and 104, as well as signal interactions between the two devices 102 and 104.

The primary assistant 102 may have a digital-to-analog converter (DAC) 402 that produces an analog speaker signal 404 based on a digital output signal 406 received from the audio source 208. The primary assistant 102 may also have an analog-to-digital converter (ADC) 408 that produces a digital microphone input signal 410 based on an analog signal 412 received from the microphone 204. The digital microphone input signal 410 is provided to the AEC component 212. The AEC component 212 performs AEC based on the output signal 406, which acts as a reference signal for the AEC. The AEC component 212 produces the echo-cancelled microphone input signal 216, which may be provided to speech recognition and understanding components 414. The speech recognition and understanding components 414 are implemented by the cloud services 112 in the described embodiment, although they may alternatively be implemented by one or both of the assistants 102 and 104.

The reference signal 202 is provided to the secondary assistant 104 as described above. In this example, the reference signal 202 may comprise or be derived from the digital output signal 406.

The primary assistant 102 has a signal clock 416 that establishes the signal rates of the various digital signals such as the output signal 406, the digital microphone input signal 410, the echo-cancelled microphone input signal 216, and the reference signal 202. More specifically, the signal clock 416 generates a reference clock signal 418 having clock cycles that repeat at a reference signal rate. The audio source 208, the DAC 402, and the ADC 408 are responsive to the reference clock signal 418, and therefore generate the output signal 406, the digital microphone input signal 410, the echo-cancelled microphone input signal 216, and the reference signal 202 at a the reference signal rate. In the described embodiment, the nominal reference signal rate is 48 kHz.

The primary assistant 102 may also have a digital counter 420 that produces a reference index 422 having a value that increases in response to cycles of the clock signal 418. The digital counter 420 may in some embodiments comprise a register that contains the index value. The counter 420 receives the clock signal 418 and increments the index value in response to each cycle of the clock signal 418.

The primary assistant 102 periodically and/or repeatedly provides the current value of the reference index 422 to the secondary assistant 104. For example, as illustrated in FIG. 2, the current value 222 of the reference index may be provided to the secondary assistant 104 along with each frame 218 of reference signal values 220.

The secondary assistant 104 has an ADC 424 that produces a digital microphone input signal 426 based on an analog signal 428 received from the microphone 224. More specifically, the ADC 424 converts the analog microphone signal 428 to a digital signal 426 representing the input audio at an input signal rate.

The AEC component 228 of the secondary assistant 104 receives the microphone input signal 426 and also receives the reference signal 202 from the primary assistant 102. The ACE component 228 performs AEC on the microphone input signal 426 to produce the echo-cancelled microphone input signal 230, which may be provided to the primary assistant 102 and/or to the speech recognition and understanding components 414.

The secondary assistant 104 has a signal clock 430 that establishes the input signal rate of the digital microphone input signal 426. More specifically, the clock 430 generates an input clock signal 432 having clock cycles that repeat at an input signal rate. The ADC 424 is responsive to the clock signal and therefore produces the digital microphone input signal 426 at the input signal rate established by the frequency of the clock signal 432.

In certain embodiments, the clock signal 432 of the secondary assistant 104 and the clock signal 418 of the primary assistant 102 have the same nominal frequencies, which in the described embodiment is 48 kHz. However, the clocks 416 and 430 may drift slightly over time and may therefore exhibit slightly different rates. Furthermore, the differences between the rates of the clock signal 432 and the clock signal 418 may vary with time.

The secondary assistant 104 may have a digital counter 434 that produces an input index 436 based at least in part on the input signal rate. More specifically, the digital counter 434 counts cycles or multiples of cycles of the clock signal 432 to produce the input index 436. The input index 436 has a value that increases monotonically in response to cycles of the clock signal 432. In some embodiments, the digital counter 434 may increment the value of the input index 436 in response to each cycle of the clock signal 432. For example, in response to a clock cycle the value of the input index 436 may be incremented from a value N to a value N+1. In other embodiments, the input index 436 may be incremented by one after every M clock cycles. As a specific example, the value of the input index 436 may comprise a sequence N, N+1, N+2, . . . .

The secondary assistant 104 may also have a rate corrector or rate adjustment components that are configured to adjust the rates or one or both of the reference signal 202 and the microphone input signal 426 so that the rates of the reference signal 202 and the microphone input signal 426 are approximately the same. The rate adjustment components may include a rate difference calculator 438 that is configured to compare the values of the reference index 422 and the input index 436 over time to determine a rate difference between the clocks 416 and 430 of the primary and secondary assistants 102 and 104. The rate adjustment components may also include a rate converter 440 corresponding to either or both of the reference signal 202 and microphone input signal 426. The rate converters 440 are responsive to the rate difference calculator to process the microphone input signal 426 and/or the reference signal 202 to correct for any signal rate difference detected by the rate difference calculator 438.

The rate difference calculator 438 determines the rate difference between the clocks 416 and 430 by comparing differences between the current values of the reference index and the input index over time. If both of the clocks 416 and 430 are running at exactly the same frequency, the difference between the values of the reference index and the input index over time will remain constant. If the clock 430 of the secondary assistant 104 is running at a slightly different frequency than the frequency of the clock 416 of the primary assistant 102, however, the difference between the values of the reference index 422 and the input index 436 will change over time.

Figure 5:
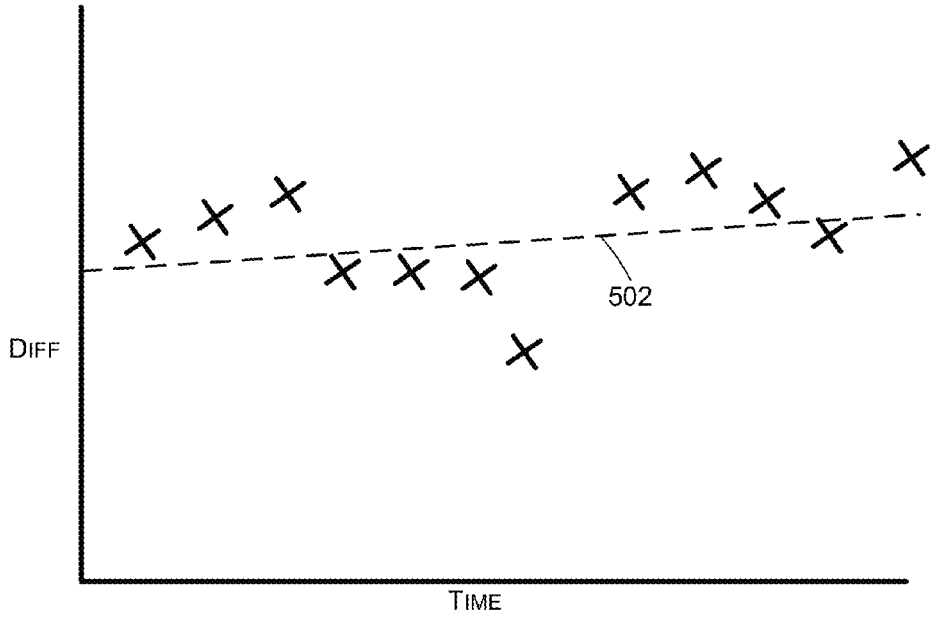
FIG. 5 is a graph illustrating differences between reference index values and input index values over time.

FIG. 5 illustrates an example of changing differences between the values of the reference and input indexes over time. In FIG. 5, the horizontal axis correspond to time. The vertical axis represents the difference between values of the reference and input indexes.

Upon receiving each reference index value 222, the rate difference calculator 438 notes or records a corresponding current value of the input index and calculates the difference between the reference and input index values. This results in an index value difference corresponding to each received reference index value. In FIG. 5, each index value difference is denoted by an "x". In this example, each difference comprises the value of the input index minus the value of the reference index.

The dashed line 502 indicates the smoothed or time-averaged differences over time. The slope of the line 502 indicates the rate of change of the differences. In this example, the difference does not remain constant. Rather, the line 502 has a positive slope indicating a positive rate of change of the difference. In other words, the input index is increasing at a higher rate than the reference index. This means that the input clock signal 432 is running at a higher rate than the reference clock signal 418, and that the input signal rate is greater than the reference signal rate.

Figure 6:
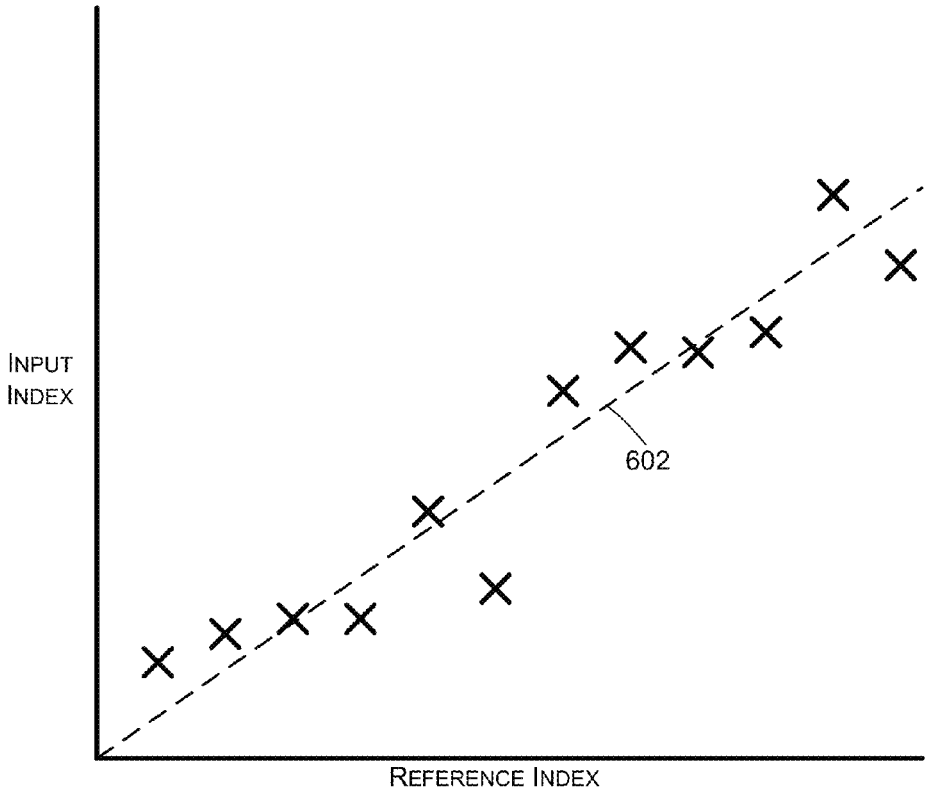
FIG. 6 is a graph illustrating input index values as a function of reference index values.

FIG. 6 illustrates an example of input index values versus reference index values over time. In FIG. 6, the horizontal axis corresponds to reference index values and the vertical axis corresponds to input index values. Each "x" mark in FIG. 6 indicates one received reference index value and the corresponding value of the input index at the time the reference index value is received. Over time, both the reference index value and the index value increase. However, they are increasing at different rates in this example.

A dashed line 602 indicates an average slope of the reference versus input index values. If the reference index and the input index change at the same rate, the slope will be equal to 1. If the input index changes more slowly than the reference index, the slope will be less than 1. If the input index changes more quickly than the reference index, the slope will be greater than 1. In the example shown by FIG. 6, the slope is less than 1, indicating that the index is changing at a higher rate than the reference index, and that the signal rate at the secondary assistant is greater than the signal rate at the primary assistant.

The lines 502 and 602 can be calculated by linear regression, based on corresponding reference and input index values accumulated over a relatively long time frame, such as several minutes. In some cases, filtering may be applied to the streams of reference and input index values to speed convergence. For example, low pass filters may be applied to the streams of index values, and/or outlying data points may be discarded.

A rate difference between the reference signal rate and the index signal rate may be calculated based on the slopes of either of the lines 502 and 602. The rate difference may be calculated in terms of values per million, for example. A rate different of 5 values per million indicates that 5 values need to be added to or subtracted from the digital microphone input signal 426 over the course of a million signal values in order to make the signal rate of the digital microphone input signal 426 equal to the signal rate of the reference signal 202.

Returning again to FIG. 4, the rate converters 440 are configured to add or remove values of the microphone input signal 426 and/or reference signal 202 so that the time-averaged signal rate of the microphone input signal 426 is equal to the time-averaged signal rate of the reference signal 202.

In certain embodiments, the secondary assistant 104 may have a first rate converter 440(*a*) corresponding to the microphone input signal 426 and a second rate converter 440(*b*) corresponding to the reference signal 202. Each of the rate converters 440(*a*) and 440(*b*) may be configured to remove values from the corresponding signal based on rate differences calculated by the rate difference calculator 438 with the goal of reducing differences between the signal rates of the microphone input signal 426 and reference signal 202. More specifically, the first rate converter 440(*a*) may remove or drop values from the microphone input signal 426 when the signal rate of the microphone input signal 426 is greater than the signal rate of the reference signal 202. The second rate converter 440(*b*) may remove or drop values from the reference signal 202 when the signal rate of the microphone input signal 426 is less than the signal rate of the reference signal 202.

In other embodiments, the secondary assistant 104 may have only one of first and second rate converters 440(*a*) or 440(*b*). In these embodiments, the single rate converter may be configured to either insert values into the corresponding signal or to remove values from the corresponding signal, depending on which of the signals has a higher signal rate.

For example, one embodiment may use only the rate converter 440(*a*), which may be configured to insert values into the microphone input signal 426 when the input signal rate is less than the reference signal rate and to remove values from the corresponding signal when the input signal rate is greater than the reference signal rate. Alternatively, the single rate converter 440(*b*) may be used to add or subtract values of the reference signal 202 in response to a difference in the time-averaged signal rates of the microphone input signal 426 and the reference signal 202.

Figure 7:
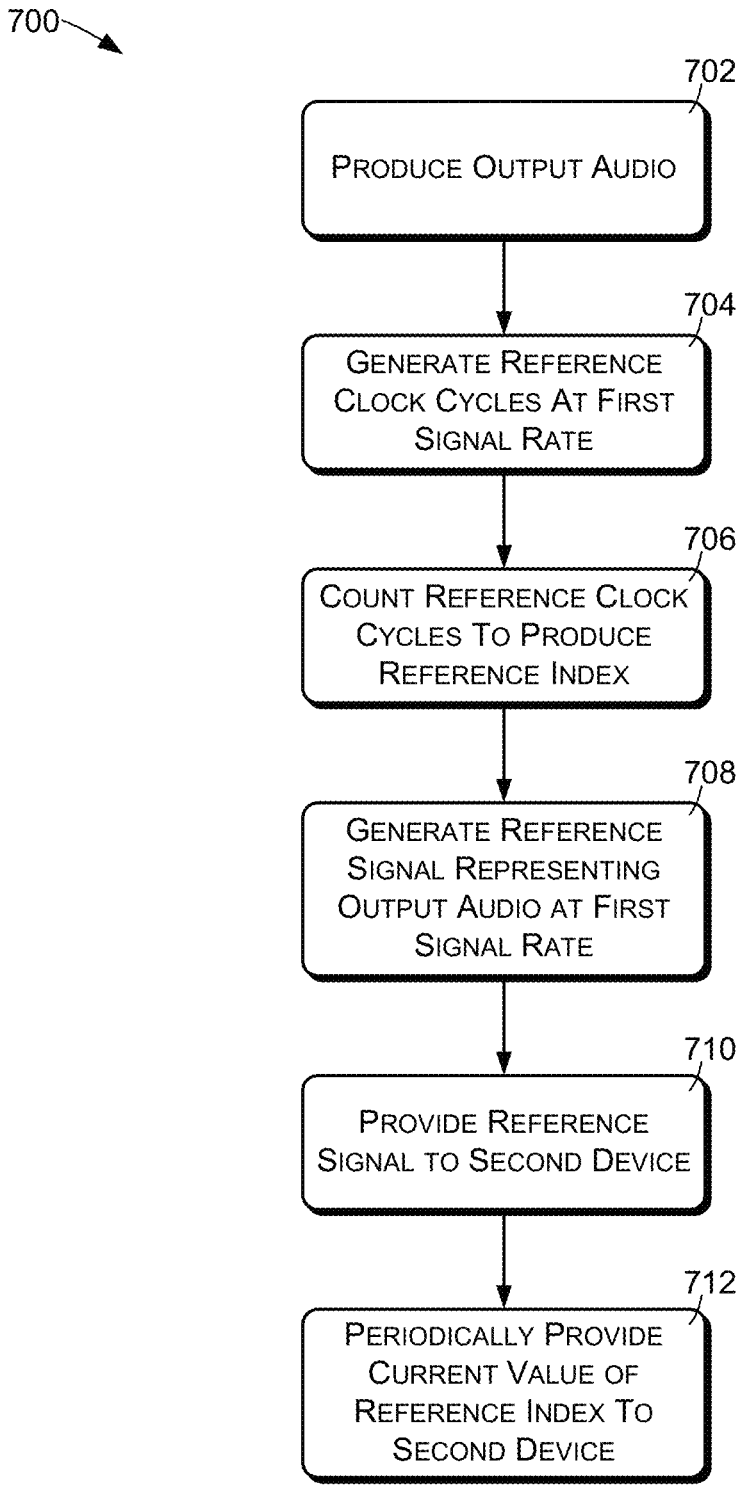
FIG. 7 is a flow diagram illustrating actions that may be performed by the primary assistant shown in FIG. 1.

FIG. 7 illustrates an example of a method 700 that may be performed at or by a first audio device such as the primary assistant 102. An action 702 comprises producing output audio at a loudspeaker of the first device. The output audio may comprise music, spoken word, synthesized speech, and so forth.

An action 704 comprises generating reference clock cycles at a first signal rate to form a reference clock signal. An action 706 comprises counting the reference clock cycles to produce a reference index. The value of the reference index may increase with each reference clock cycle or with each multiple of reference clock cycles.

An action 708 comprises producing or generating a reference signal that represents the output audio at the first signal rate. An action 710 comprises providing the reference signal to a second device such as the secondary assistant 104. An action 712 comprises periodically and/or repeatedly providing a current value of the reference index to the second device. As described above, the reference signal may be provided as sequential frames of reference signal values, and the current value of the reference index may be provided with each reference signal frame.

Figure 8:
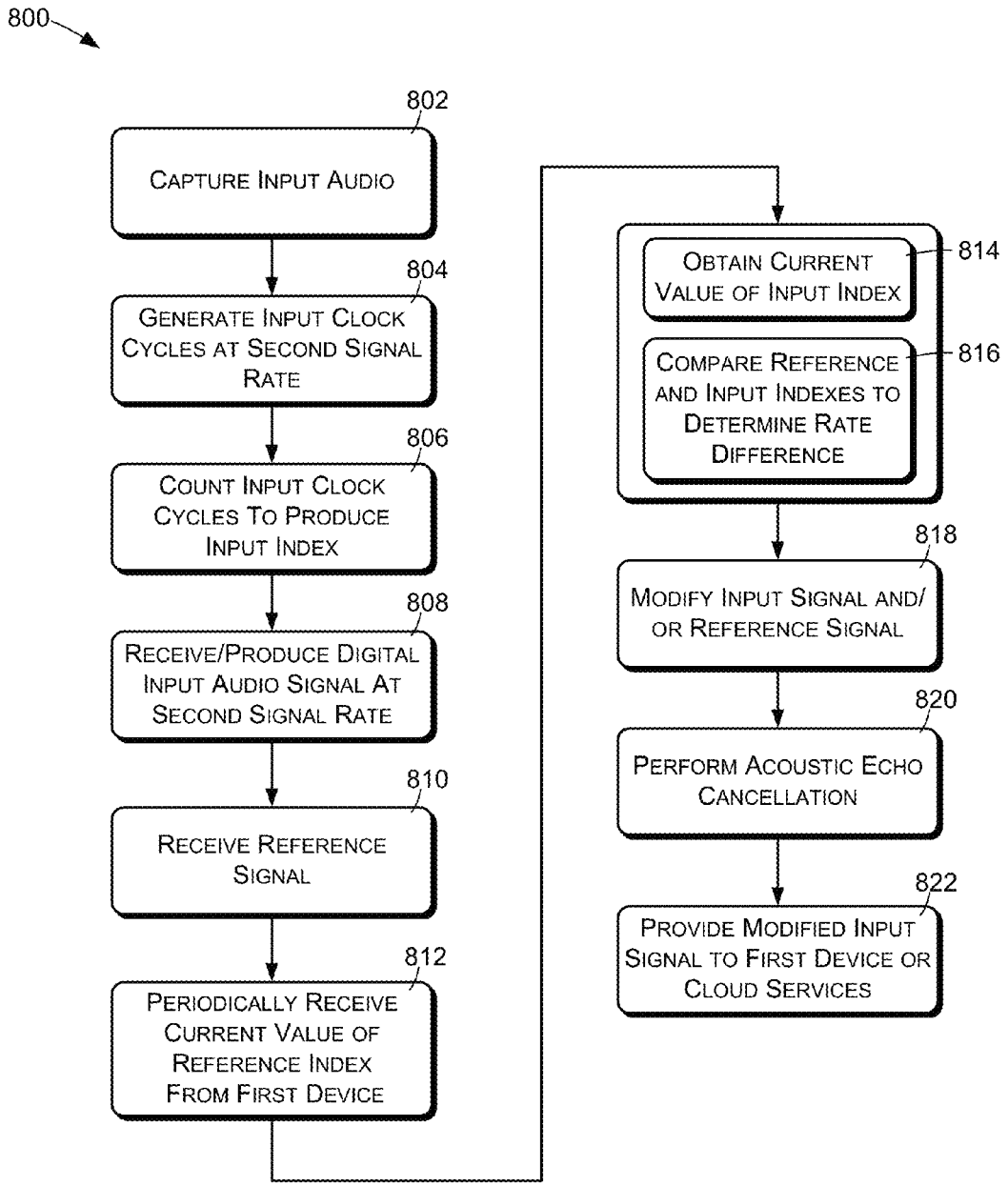
FIG. 8 is a flow diagram illustrating actions that may be performed by the secondary assistant shown in FIG. 1.

FIG. 8 illustrates an example of a method 800 that may be performed at or by a second audio device such as the secondary assistant 104. An action 802 comprises receiving input audio using a microphone of the second device. The input audio may include the output audio produced by the first device, due to direct and indirect acoustic paths between the first and second devices, including reflective acoustic paths.

An action 804 comprises generating input clock cycles at a second signal rate to form an input clock signal. An action 806 comprises counting the input clock cycles to produce an input index. The value of the input index may increase with each reference clock cycle or with each multiple of reference clock cycles.

In the described embodiment, the first and second signal rates are nominally the same, subject to independent rate drift. In other embodiments, the nominal first and second signal rates be different from each other by a known factor or multiplier, again subject to independent rate drift.

In certain embodiments, both of the first and second devices may utilize similar components and may have processors that operate based on processor clock signals of the same frequency. Signal rates may be established by the processor clock frequency, while the reference and input indexes are also based on the processor clock signals.

An action 808 comprises producing, obtaining, or receiving a digital input audio signal representing the input audio captured in the action 802. The input audio signal may be generated by an ADC component that is clocked by the input clock signal, so that the input audio signal has an input signal rate that is equal to the second signal rate.

An action 810 comprises periodically and/or repeatedly receiving the reference signal that is provided from the first device at a reference signal rate. An action 812 comprises periodically and/or repeatedly receiving the current value of the reference index from the second device. The actions 810 and 812 may comprise periodically and/or repeatedly receiving reference frames from the first device, wherein each reference frame comprises multiple reference signal values and a corresponding value of the reference index.

A pair of actions 814 and 816 are performed in response to receiving the current value of the reference index. The action 814 comprises obtaining the current value of the input index, which is then associated with the received current value of the reference index. The action 816 comprises comparing the current values of the reference and input indexes to determine whether the current value of the reference index is changing at a higher rate then the corresponding current value of the input index or whether the current value of the reference index is changing at a lower rate than the corresponding current value of the input index.

More specifically, the action 816 may comprise comparing the current values of the reference and input indexes to determine a rate difference. The rate difference is the difference between the first signal rate and the second signal rate or the difference between the signal rates of the reference and microphone input signals.

The action 816 may be performed by comparing the rate of change of the reference index and the rate of change of the input index based at least in part on the repeatedly provided current value of the reference index and the corresponding current value of the input index. In certain embodiments, the comparing may comprise averaging differences between changes in the repeatedly received current value of the reference index and changes in the corresponding current values of the input index. In certain embodiments, the comparing may comprise performing a linear regression analysis of the provided current value of the reference index versus the corresponding current value of the input index over time.

An action 818 comprises processing or modifying the input signal and/or the reference signal to correct for the determined rate difference. In certain embodiments, this may be performed by (a) increasing the signal rate of the input signal if the rate of change of the input index is less than the rate of change of the reference index and (b) decreasing the signal rate of the input signal if the rate of change of the input index is greater than the rate of change of the reference index. Increasing the signal rate may be performed by adding input signal values to the input signal. The added values may comprise duplicated values or interpolated values. Decreasing the signal rate may comprise removing input signal values from the input signal. Values are added to the input signal when the received current value of the reference index is changing at a higher rate than the corresponding current value of the input index. Values are removed from the input signal when the received current value of the reference index is changing at a lower rate than the corresponding current value of the input index.

In other embodiments, either or both of the input signal and the reference signal may be modified to correct for signal rate differences. For example, values may be dropped or removed from whichever of the input signal and reference signal have a higher signal rate.

An action 820 comprises processing the modified input signal based at least in part on the reference signal to suppress the output audio in the input signal. The action 820 may be performed by acoustic echo cancellation techniques such as described above with reference to FIG. 3. An action 822 comprises providing the resulting echo-cancelled microphone input signal to either the first device or to cloud services for voice recognition.

Figure 9:
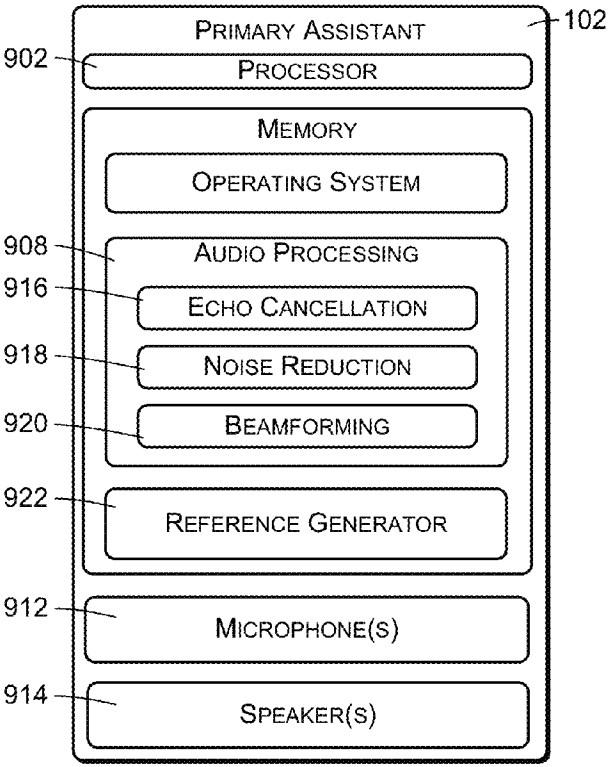
FIG. 9 is a block diagram illustrating example components and functionality of the primary assistant.

FIG. 9 shows an example functional configuration of the primary assistant 102. The primary assistant 102 includes operational logic, which in many cases may comprise a processor 902 and memory 304. The processor 902 may include multiple processors and/or a processor having multiple cores. The memory 904 may contain applications and programs in the form of instructions that are executed by the processor 902 to perform acts or actions that implement desired functionality of the primary assistant 102. The memory 904 may be a type of computer storage media and may include volatile and nonvolatile memory. Thus, the memory 904 may include, but is not limited to, RAM, ROM, EEPROM, flash memory, or other memory technology.

The primary assistant 102 may have an operating system 906 that is configured to manage hardware and services within and coupled to the primary assistant 102. In addition, the primary assistant 102 may include audio processing components 908 for capturing and processing audio including user speech. The operating system 906 and audio processing components 908 may be stored by the memory 904 for execution by the processor 902.

The primary assistant 102 may have one or more microphones 912 and one or more speakers 914. The one or more microphones 912 may be used to capture audio from the environment of the user, including user speech. The one or more microphones 912 may in some cases comprise a microphone array configured for use in beamforming. The one or more speakers 914 may be used for producing sound within the user environment, which may include generated or synthesized speech.

The audio processing components 908 may include functionality for processing input audio signals generated by the microphone(s) 912 and/or output audio signals provided to the speaker(s) 914. As an example, the audio processing components 906 may include one or more acoustic echo cancellation or suppression components 916 for reducing acoustic echo in microphone input signals, generated by acoustic coupling between the microphone(s) 912 and the speaker(s) 914. The audio processing components 908 may also include a noise reduction component 918 for reducing noise in received audio signals, such as elements of audio signals other than user speech.

The audio processing components 908 may include one or more audio beamformers or beamforming components 920 that are configured to generate or produce multiple directional audio signals from the input audio signals received from the one or more microphones 912.

The primary assistant 102 may also implement a reference generation function or component 922. The reference generation function or component 922 provides an output reference signal to the secondary assistant 104 so that the secondary assistant 104 can perform AEC. In addition, the reference generation function or component 922 provides sample rate information to the secondary assistant 104 as described above so that the secondary assistant 104 can more effectively perform AEC.

Figure 10:
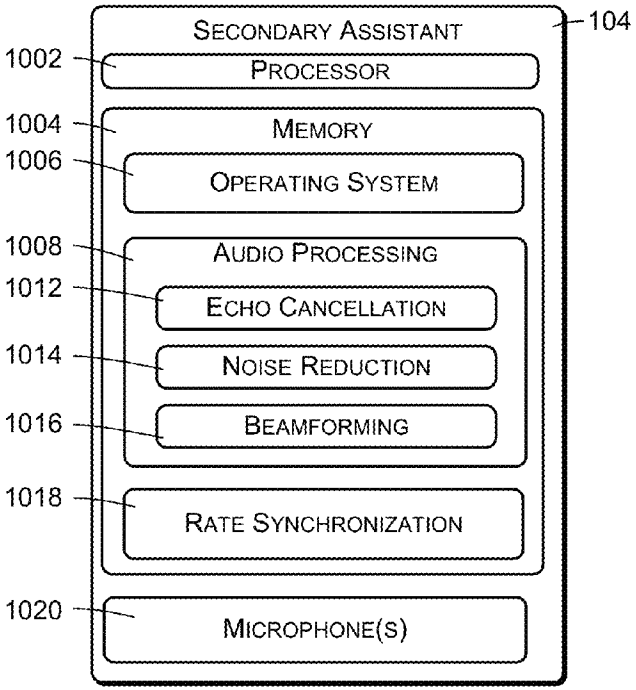
FIG. 10 is a block diagram illustrating example components and functionality of the secondary assistant.

FIG. 10 shows an example functional configuration of the secondary assistant 104. In certain embodiments, the secondary assistant 104 may implement a subset of the functionality of the primary assistant 102. For example, the secondary assistant 104 may function primarily as an auxiliary microphone unit that provides a secondary audio signal to the primary assistant 102. The primary assistant 102 may receive the secondary audio signal and may process the secondary audio signal using the speech processing components 910.

The secondary assistant 104 includes operational logic, which in many cases may comprise a processor 1002 and memory 1004. The processor 1002 may include multiple processors and/or a processor having multiple cores. The memory 1004 may contain applications and programs in the form of instructions that are executed by the processor 1002 to perform acts or actions that implement desired functionality of the secondary assistant 104. The memory 1004 may be a type of computer storage media and may include volatile and nonvolatile memory. Thus, the memory 1004 may include, but is not limited to, RAM, ROM, EEPROM, flash memory, or other memory technology.

The secondary assistant 104 may have an operating system 1006 that is configured to manage hardware and services within and coupled to the secondary assistant 104. In addition, the secondary assistant 104 may include audio processing components 1008. The operating system 1006 and audio processing components 1008 may be stored by the memory 1004 for execution by the processor 1002.

The primary assistant 102 may have one or more microphones 1010, which may be used to capture audio from the environment of the user, including user speech. The one or more microphones 1010 may in some cases comprise a microphone array configured for use in beamforming.

The audio processing components 1008 may include functionality for processing input audio signals generated by the microphone(s) 1010. As an example, the audio processing components 1008 may include one or more acoustic echo cancellation or suppression components 1012 for reducing acoustic echo in microphone input signals, generated by acoustic coupling between the speaker(s) 914 of the primary assistant 102 and the microphone(s) 1010 of the secondary assistant 104. The audio processing components 908 may also include a noise reduction component 1014 for reducing noise in received audio signals, such as elements of audio signals other than user speech.

The audio processing components 1008 may include one or more audio beamformers or beamforming components 1016 that are configured to generate or produce multiple directional audio signals from the input audio signals received from the one or more microphones 1010.

The primary assistant 102 may also implement a rate correction or synchronization component 1018. As described above, the secondary assistant 104 receives a reference signal from the primary assistant 102. The rate correction or synchronization component 1018 adjusts microphone signals within the secondary assistant 104 so that the signal rates of the microphone signals match the signal rate of the reference signal.

Although the subject matter has been described in language specific to structural features, it is to be understood that the subject matter defined in the appended claims is not necessarily limited to the specific features described. Rather, the specific features are disclosed as illustrative forms of implementing the claims.

The invention claimed is:

1. A method, comprising:

producing output audio at a speaker of a first device;

generating reference clock cycles at the first device to establish a first signal rate;

generating a digital reference signal that contains the output audio at the first signal rate;

maintaining a reference index at the first device, the reference index having a value that is incremented in response to the reference clock cycles;

providing the digital reference signal to a second device;

repeatedly providing a current value of the reference index to the second device;

generating input clock cycles at the second device to establish a second signal rate;

generating a digital audio signal from a microphone of the second device at the second signal rate, wherein the digital audio signal contains the output audio produced by the first device;

maintaining an input index at the second device, the input index having a value that is incremented in response to the input clock cycles;

determining a rate of change of the reference index and a rate of change of the input index based at least in part on the repeatedly provided current value of the reference index and a corresponding current value of the input index;

comparing the rate of change of the reference index and the rate of change of the input index to determine a signal rate difference between the first and second signal rates;

increasing or decreasing at least one of the second signal rate of the digital audio signal or the first signal rate of the digital reference signal to reduce the signal rate difference; and performing acoustic echo cancellation at the second device in response to the digital reference signal to suppress the output audio in the digital audio signal.

2. The method of claim 1, wherein:

each of the digital audio signal and the digital reference signal comprises a series of signal values;

increasing the at least one of the second signal rate of the digital audio signal or the first signal rate of the digital reference signal comprises repeatedly adding signal values to at least one of the digital audio signal and the digital reference signal; and decreasing the at least one of the second signal rate of the digital audio signal or the first signal rate of the digital reference signal comprises repeatedly removing signal values from at least one of the digital audio signal and the digital reference signal.

3. The method of claim 2, wherein the added signal values comprise duplicated signal values.

4. The method of claim 2, wherein the added signal values comprise interpolated signal values.

5. A first device, comprising:

a microphone that produces an analog audio signal containing first audio from a speaker of a second device;

a conversion component that converts the analog audio signal to a digital audio signal having a first signal rate;

a counter that produces an input index having a value that changes in synchronization with the first signal rate;

an acoustic echo canceller configured to receive a digital reference signal from the second device, the digital reference signal containing the first audio and having a second signal rate, wherein the acoustic echo canceller is responsive to the digital reference signal to suppress the first audio in the digital audio signal; and one or more correction components configured to:

receive first and second values of a reference index from the second device at first and second times, respectively, wherein the values of the reference index change in synchronization with the second signal rate;

compare the first and second values of the reference index to corresponding first and second values of the input index at the first and second times, respectively, to determine a signal rate difference between the digital reference signal and the digital audio signal; and process at least one of the digital audio signal or the digital reference signal to reduce the signal rate difference.

6. The first device of claim 5, wherein the conversion component converts the analog audio signal to the digital audio signal in response to a clock signal, wherein the counter increments the value of the input index in response to cycles of the clock signal.

7. The first device of claim 5, wherein the one or more correction components compare a change of the first and second values of the reference index and a change of the corresponding first and second values of the input index to determine the signal rate difference.

8. The first device of claim 5, wherein the one or more correction components average differences between changes in the first and second values of the reference index and changes in the first and second values of the input index to determine the signal rate difference.

9. The first device of claim 5, wherein the one or more correction components perform a linear regression analysis of the first and second values of the reference index versus the first and second values of the input index to determine the signal rate difference.

10. The first device of claim 5, wherein:

the digital reference signal is received in groups of reference signal values; and the first and second values of the reference index are associated with first and second groups of the reference signal values, respectively.

11. The first device of claim 5, wherein the one or more correction components are further configured to process said at least one of the digital audio signal or the digital reference signal by removing values from at least one of the digital audio signal or the digital reference signal.

12. A method, comprising:

obtaining an analog signal via a microphone at a first device, the analog signal representing audio output by a speaker of a second device;

obtaining a first digital signal having a first signal rate, the first digital signal based at least in part on the analog signal;

producing a first index having values that change in synchronization with the first signal rate;

receiving a second digital signal having a second signal rate;

receiving first and second values of a second index, wherein the values of the second index change in synchronization with the second signal rate;

comparing the first and second values of the second index to corresponding first and second values of the first index to determine a rate difference between the first signal rate and the second signal rate;

processing at least one of the first and second digital signals to reduce the rate difference; and performing acoustic echo cancellation at the first device to suppress at least a part of the audio in the first digital signal.

13. The method of claim 12, further comprising:

converting the analog signal to the first digital signal in response to a clock signal; and wherein producing the first index comprises counting cycles of the clock signal.

14. The method of claim 12, wherein the comparing comprises comparing a change of the first and second values of the second index and a change of the first and second values of the first index to determine the rate difference.

15. The method of claim 12, wherein the comparing comprises averaging differences between changes in the first and second values of the second index and changes in the first and second values of the first index to determine the rate difference.

16. The method of claim 12, wherein the comparing comprises performing a linear regression analysis of the first and second values of the second index versus the first and second values of the first index to determine the rate difference.

17. The method of claim 12, wherein:

the second digital signal is received in groups of signal values; and each of the first and second values of the second index is associated with a corresponding group of signal values of the second digital signal.

18. The method of claim 12, wherein processing at least one of the first and second digital signals comprises removing values from at least one of the first digital signal or the second digital signal.

19. The method of claim 12, wherein performing the acoustic echo cancellation further comprises:

generating an echo-cancelled signal; and providing the echo-cancelled signal to a remote computing device.

20. The method of claim 12, further comprising receiving the second digital signal from the second device.

* * * * *